United States Patent [19]

Mortimer

[11] 4,304,017

[45] Dec. 8, 1981

[54] COLLAPSIBLE STRUCTURE PARTICULARLY FOR USE AS A COT OR BED

[75] Inventor: Frank R. Mortimer, Coventry, England

[73] Assignee: Andrews Maclaren Limited, Northampton, England

[21] Appl. No.: 87,635

[22] Filed: Oct. 23, 1979

[30] Foreign Application Priority Data

Oct. 24, 1978 [GB] United Kingdom ..... 41760/78

[51] Int. Cl.[3] ..... A47D 7/00

[52] U.S. Cl. ..... 5/99 A; 5/99 C; 135/4 R

[58] Field of Search ..... 5/99 R, 99 A, 99 B, 5/110, 115; 135/4 R, 7.1 R

[56] References Cited

U.S. PATENT DOCUMENTS

| | | | |
|---|---|---|---|
| 1,330,901 | 2/1920 | Richards | 5/115 |
| 2,974,325 | 3/1961 | Mango | 5/99 R |
| 3,206,773 | 9/1965 | Sarasin | 5/99 R |
| 4,202,065 | 3/1980 | Sullivan | 5/99 C |

*Primary Examiner*—Roy D. Frazier
*Assistant Examiner*—Alexander Grosz
*Attorney, Agent, or Firm*—Shapiro and Shapiro

[57] ABSTRACT

A first X-frame (10) comprising first and second pivotally connected elongate members (4 and 5) is pivotally connected to a second X-frame (33) comprising third and fourth pivotally connected elongate members (27 and 28) by means of cross-braces (21, 22, 46 and 47) so that sleeves (11, 12, 36 and 37) pivotally connected to the first ends (6, 8, 29 and 31) of the elongate members (4, 5, 27 and 28) are slidably movable along pivotally interconnected support arms (13, 14, 38 and 39). As the X-frames (10 and 33) move towards each other, the elongate members (4, 5, 27 and 28), the support arms (13, 14, 38 and 39), and the cross-braces (21, 22, 46 and 47) align themselves substantially parallel to each other, the hems of a container (55) of pliable material, which receive the support arms (13, 14, 38 and 39) are gathered together and the container (55) is compressed within the bundle of substantially parallel members.

10 Claims, 4 Drawing Figures

COLLAPSIBLE STRUCTURE PARTICULARLY FOR USE AS A COT OR BED

TECHNICAL FIELD OF THE INVENTION

The present invention relates to a collapsible structure and more particularly to a collapsible bed or cot incorporating such a structure.

BACKGROUND ART

It is known to provide collapsible structures, for use in cots and beds, comprising first and second elongate members which each have first and second ends and are pivotally interconnected to form an X-frame. It is possible to transform such a structure from an extended condition, in which the first and second ends of the elongate members are disposed at the corners of an imaginary rectangle, to a collapsed condition in which the two first ends of the elongate members, and hence the two second ends, lie adjacent each other. However, although the X-frame becomes quite compact when the structure is in its collapsed condition, difficulty is encountered in arranging the other components of the structure, which are connected to the X-frame, so that the structure is compact when in its collapsed condition.

DISCLOSURE OF THE INVENTION

It is therefore an object of the present invention to overcome this deficiency of known collapsible structures in a collapsible structure which is inexpensive and simple to manipulate.

Accordingly, this object is achieved by providing the structure with first and second sleeves respectively connected, for pivotal movement, to the first ends of the first and second elongate members; first and second support arms respectively slidable within the first and second sleeves and each having first and second ends; first and second stops respectively provided at the first ends of the first and second support arms; first and second cross-braces respectively provided with first ends pivotally connected to the second ends of the first and second support arms, respectively, and respectively provided with second ends pivotally connected at or adjacent the second ends of the second and first elongate members respectively; and support means for limiting the separation of the second ends of the first and second support arms.

With a structure such as this, the stops on the first ends of the support arms limit movement of the sleeves, and hence the first X-frame, away from the support means when the structure is in its extended condition. However, the structure can be collapsed by sliding the sleeves along the support arms until the first ends of the elongate members are adjacent the second ends of the support arms. During this movement, the cross-braces pivot relative to the support arms and so cause the first and second elongate members of the X-frame to rotate relative to each other so that the first ends of these elongate members, and hence also the second ends, come together. As a result, the elongate members, support arms and cross-braces all extend substantially parallel to each other to form a compact bundle. The compactness of this bundle is determined by the dimensions of the components and can be easily adjusted to obtain acceptable results.

In a first, simple embodiment of the invention, the support means include third and fourth elongate members which each have first and second ends and are pivotally interconnected to form a second X-frame. In this construction, the first end of the third and fourth elongate members may be pivotally connected to the second ends of the support arms and the separation of the second ends of the support arms may be effected by the providing tie means between the second ends of the third and fourth elongate members of the second X-frame.

With this form of construction, a first bracket may provide pivotal connections for the second end of the first support arm and for the first end of the first cross-brace which are respectively pivotable about two spaced parallel axes; and a second bracket may provide pivotal connections for the second end of the second support arm and for the first end of the second cross-brace which are respectively pivotable about two spaced parallel axes. This separation of axes facilitates movement of the sleeves along the support arms towards the second ends of the support arms.

In an alternative form of construction, the support means constitute a sub-assembly which is identical to the remainder of the structure. In this case, third and fourth sleeves are respectively connected, for pivotal movement, to the first ends of the third and fourth elongate members; third and fourth support arms are respectively slidable within the third and fourth sleeves and each have first and second ends; third and fourth stops are respectively provided at the first ends of the third and fourth support arms; and third and fourth cross-braces are respectively provided with first ends pivotally connected to the second ends of the third and fourth support arms, respectively, and respectively provided with second ends pivotally connected at or adjacent the second ends of the fourth and third elongate members, respectively. With this form of construction, the second ends of the first and third support arms are interconnected and are each pivotable about an axes which extends perpendicular to a plane defined by the axes of the first and third support arms and the axis of the first and third cross-braces; and the second ends of the second and fourth support arms are interconnected and are each pivotable about an axis which extends perpendicular to a plane defined by the axes of the second and fourth support arms and the axes of the second and fourth cross-braces.

In this case, the second ends of the first and second support arms support the second ends of the third and fourth support arms so as to limit separation of the second ends of the third and fourth support arms. At the same time, the second ends of the third and fourth support arms limit separation of the second ends of the first and second support arms.

In a preferred construction of this second embodiment of the invention, a first interconnecting bracket provides pivotal connections for the second ends of the first and third support arms which second ends are respectively pivotable about spaced axes extending perpendicular to a plane defined by the axes of the first and third support arms and of the first and third cross-braces; and a second interconnecting bracket provides pivotal connections for the second ends of the second and fourth support arms which second ends are respectively pivotable about two spaced axes extending perpendicular to a plane defined by the axes of the second and fourth support arms and of the second and fourth cross-braces. Here again, this separation of pivotal axes facilitates movement of the sleeves along the support arms towards the second ends of the support arms.

Locking means, for holding structures according to the invention in an extended condition, include stiffening strips extending between the first and second ends of each support arm so as to separate the sleeve which slidably receives said support arm in abutment with the stop provided at the first end of said support arm. Moreover, where the support arms support a collapsible container which has a rim attached to the support arms, to form a collapsible cot, the stiffening strips may be attached to this rim of the container.

A container such as this is preferably a rectangular parallelepiped having rectilinear edges and so stiffening members may be provided for reinforcing at least some of these edges so as to impart additional rigidity to the structure. In addition, to provide even further rigidity, at least some of these edges may be detachably connected to the cross-braces of the structure.

Embodiments of the invention are hereinafter described, by way of example, with reference to the accompanying drawings.

BEST MODES FOR CARRYING OUT THE INVENTION

Figure 1:
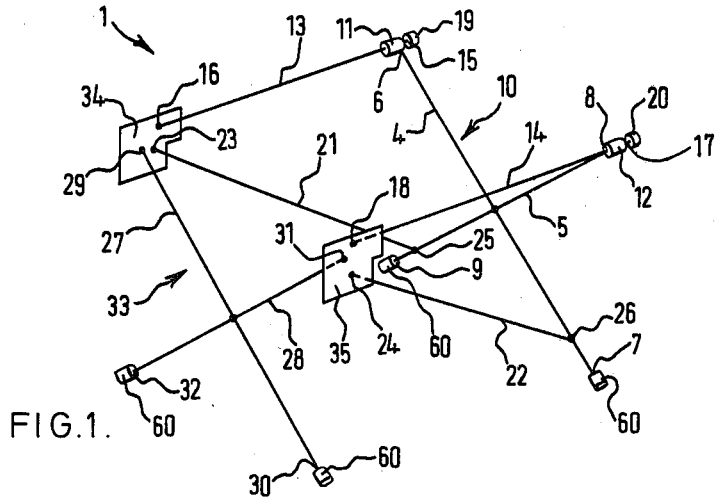
FIG. 1 is a schematic perspective view of a collapsible structure according to one embodiment of the present invention.

The collapsible structure 1 shown in FIG. 1 comprises a first X-frame 10 having first and second elongate members 4 and 5 which are pivotally interconnected and a second X-frame 33 having third and fourth elongate members 27 and 28. First and second support arms 13 and 14 and first and second cross-braces 21 and 22 interconnect the two X-frames 10 and 33.

First and second sleeves 11 and 12 are pivotally connected to the first ends 6 and 8 of the first and second elongate members 4 and 5 of the first X-frame 10 and slidably receive the first and second support arms 13 and 14. Stops 19 and 20 provided on the first ends 15 and 17 of the support arms 13 and 14 limit movement of the support arms 13 and 14 relative to the first X-frame 10 and the second ends 16 and 18 of the support arms 13 and 14 are pivotally connected to brackets 34 and 35. The first ends 23 and 24 of the two cross-braces 21 and 22 are also pivoted to the brackets 34 and 35 and the second ends 25 and 26 of the first and second cross-braces 21 and 22 are pivotally connected to the second and first elongate members 5 and 4 respectively, adjacent the second ends 9 and 7 of these members. As shown, the first ends 29 and 31 of the third and fourth elongate members 27 and 28 are also pivotally connected to the brackets 34 and 35. The second X-frame 33 therefore serves as support means for limiting separation of the second ends 16 and 18 of the first and second support arms 13 and 14. This may be achieved by connecting tie means (not shown) between the second ends 30 and 32 of the third and fourth elongate members 27 and 28. Rubber feet 60 are attached to the elongate members forming the two X-frames so that the collapsible structure can be stood upon a support surface.

In order to collapse the structure 1 from its extended condition, as shown in FIG. 1, the first X-frame 10 is moved towards the second X-frame 33. This causes the first and second cross-braces 21 and 22 to swing away from the first and second support arms 13 and 14. As a result, the second ends 9 and 7 of the second and first elongate members 5 and 4 are respectively moved away from the first ends 6 and 8 of the first and second elongate members 4 and 5. Thus, as the first ends 6 and 8 of the first and second elongate members 4 and 5 are moved towards the second ends 16 and 18 of the first and second support arms 13 and 14, these first ends 6 and 8 move towards each other. At the same time, the first and second elongate members 4 and 5 pivot about the sleeves 11 and 12 and so align themselves substantially parallel with the support arms 13 and 14 and with the cross-braces 21 and 22.

The third and fourth elongate members 27 and 28 of the second X-frame 33 collapse in a similar manner to the elongate members 4 and 5 of the first X-frame 10 and so, as all of the elongate members depend from the brackets 34 and 35, these brackets 34 and 35 are conveniently formed as carrying handles.

Figure 2:
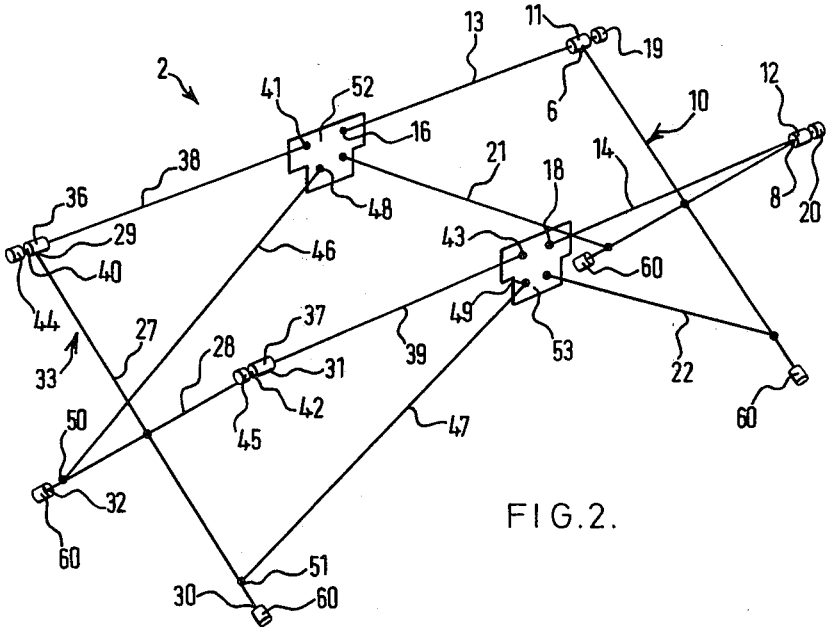
FIG. 2 is a schematic perspective view of another embodiment of the present invention.

In the embodiment illustrated in FIG. 2, the brackets 34 and 35 of the embodiment illustrated in FIG. 1 are replaced by brackets 52 and 53 and the second X-frame 33 is connected to these brackets 52 and 53 in the same manner as the first X-frame 10. Thus, third and fourth sleeves 36 and 37 are pivotably connected to the first ends 29 and 31 of the third and fourth elongate members 27 and 28; third and fourth support arms 38 and 39 are slidably received in these sleeves 36 and 37 and have first and second stops 44 and 45 at their first ends 40 and 42 and are pivotally connected to the brackets 52 and 53 at their second ends 41 and 43; and third and fourth cross-braces 46 and 47 have first ends 48 and 49 respectively pivoted to the brackets 52 and 53 and second ends 50 and 51 respectively pivoted to the fourth and third elongate members 28 and 27, adjacent the second ends 32 and 30 of these elongate members 28 and 27.

Figure 3:
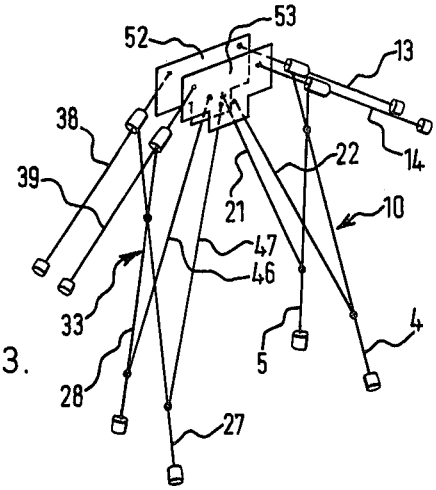
FIG. 3 is a schematic perspective view of the collapsible structure shown in FIG. 2, showing the structure in a partially collapsed condition.

When the first and second X-frames 10 and 33 are moved towards the brackets 52 and 53, as shown in FIG. 3, both X-frames collapse in a similar manner to the collapse of the first X-frame 10, as described with reference to FIG. 1. Thus, the first ends 6 and 8 of the first and second elongate members 4 and 5 move together and the first ends 29 and 31 of the third and fourth elongate members 27 and 28 move together; the first and second cross-braces 21 and 22 swing away from the first and second support arms 13 and 14 and the third and fourth cross-braces 46 and 47 swing away from the third and fourth support arms 38 and 39; and, to complete the transformation from the extended condition of the structure 2 to the collapsed condition, the first and second sleeves 11 and 12 pivot about the first ends 6 and 8 of the first and second elongate members 4 and 5 and the third and fourth sleeves 36 and 37 pivot about the first ends 29 and 31 of the third and fourth elongate members 27 and 28 and so the support arms 13, 14, 38 and 39 swing towards their adjacent cross-braces 21, 22, 46 and 47 so that all of these members adopt positions substantially parallel with each other, so as to provide a compact bundle.

Figure 4:
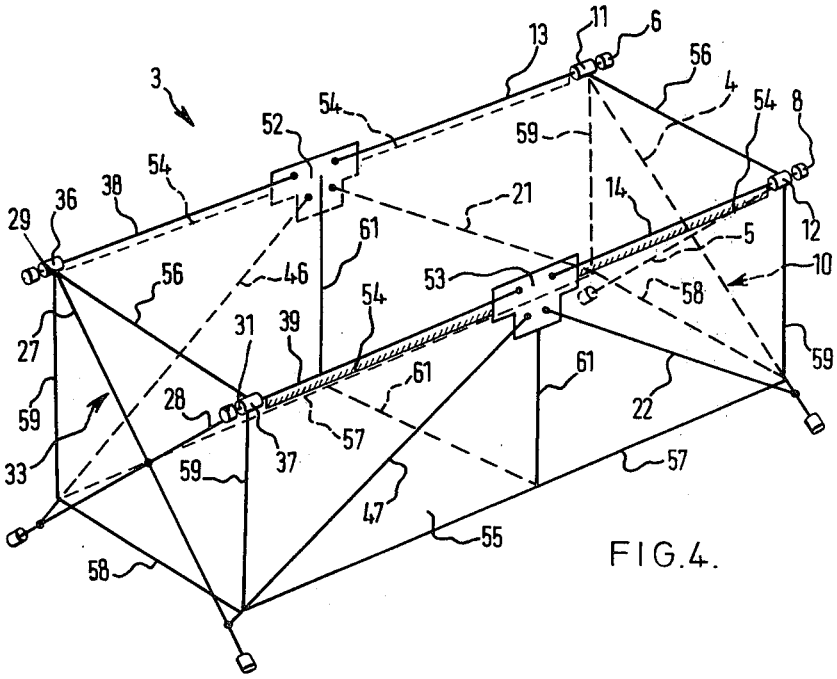
FIG. 4 is a schematic perspective view of the collapsible structure shown in FIG. 2, provided with a reinforced canvas bag suitably attached to the other components of the structure to form a collapsible bed.

In the embodiment illustrated in FIG. 4, the collapsible structure 3 includes, in addition to the components shown in FIG. 2, a container 55 of pliable material, such as cloth or canvas, in the form of an open-topped parallelepiped. Hems (not shown) formed in side portions of the rim 56 of this container 55 receive the support arms 13, 14, 38 and 39. In order to stiffen the structure 3 so as to prevent the brackets 52 and 53 from spreading apart, stiffening strips 54 extend between the sleeves 11 and 36, on one side of the structure 3, and between the sleeves 12 and 37, on the other side of the structure 3. These stiffening strips 54 are detachably connected to the hems (not shown) which receive the support arms 13, 14, 38 and 39 and may extend from each corner of the structure 3 over the whole length of the side of the structure 3 or may extend from the corners to the brackets 52 and 53 at the mid-portions of these sides.

Stiffening members 57 and 58 are detachably provided around the bottom edges of the container 55 and vertical stiffening members 59 are detachably provided at the corner edges of the container 55. Further reinforcing strips 61 extend around the central portion of the container 55. Finally, to provide still further rigidity, the four bottom corners of the container 55 are provided with swap-action clips (not shown) for detachable connection to the cross-braces 21, 22, 46 and 47 and, in normal use, a relatively stiff mattress (not shown) is installed in the bottom of the container 55.

When it is necessary to collapse the structure 3, the mattress is removed, the bottom corners of the container 55 are disconnected from the cross-braces 21, 22, 46 and 47 and the stiffening strips 54, stiffening members 57, 58 and 59, and the reinforcing strips 61 are all removed. The X-frames 10 and 33 are then moved towards each other, as described with reference to FIGS. 2 and 3.

The hems which receive the support arms 13, 14, 38 and 39 are "gathered up" and shortened in length so as to be accommodated between the sleeves 11, 12, 36 and 37 and the remainder of the container 55 is compressed, in crumpled condition, internally of the members which become aligned substantially parallel with each other.

Although reference numerals have been used in the appended claims to improve the intelligibility of these claims, it is expressly stated that these reference numerals should not be construed as limiting the claims to the constructions illustrated in the accompanying drawings.

I claim:

1. A collapsible structure (1, 2 or 3) comprising first and second elongate members (4 and 5) which each have first and second ends (6 and 7, and 8 and 9) and are pivotally interconnected to form a first X-frame (10), first and second support arms (13 and 14) which each have first and second ends (15 and 16, and 17 and 18); and first and second cross-braces (21 and 22) respectively provided with first ends (23 and 24) pivotally connected to the second ends (16 and 18) of the first and second support arms (13 and 14), respectively, and respectively provided with second ends (25 and 26) pivotally connected at or adjacent the second ends (9 and 7) of the second and first elongate members (5 and 4), respectively; characterised in that:

first and second sleeves (11 and 12) are respectively connected, for pivotal movement, to the first ends (6 and 8) of the first and second elongate members (4 and 5);

the first and second support arms (13 and 4) are respectively slidable within the first and second sleeves (11 and 12);

first and second stops (19 and 20) are respectively provided at the first ends (15 and 17) of the first and second support arms (13 and 14); and support means (27, 28, 36 to 39, 44 to 47, 52 and 53) are provided for limiting the separation of the second ends (16 and 18) of the first and second support arms (13 and 14).

2. A collapsible structure (1), according to claim 1, characterised in that:

the support means include third and fourth elongate members (27 and 28) which each have first and second ends (29 and 30, and 31 and 32) and are pivotally interconnected to form a second X-frame (33).

3. A collapsible structure (1), according to claim 2, characterised in that the first ends (29 and 31) of the third and fourth elongate members (27 and 28) respectively are pivotally connected to the second ends (16 and 18) of the first and second support arms (13 and 14).

4. A collapsible structure (1), according to claim 2 or claim 3, characterised in that:

a first bracket (34) provides pivotal connections for the second end (16) of the first support arm (13) and for the first end (23) of the first cross-brace (21) which are respectively pivotable about two spaced parallel axes; and a second bracket (35) provides pivotal connections for the second end (18) of the second support arm (14) and for the first end (24) of the second cross-brace (22) which are respectively pivotable about two spaced parallel axes.

5. A collapsible structure (2 or 3) comprising first and second elongate members (4 and 5) which each have first and second ends (6 and 7, and 8 and 9) and are pivotally interconnected to form a first frame (10);

first and second sleeves (11 and 12) respectively connected, for pivotal movement, to the first ends (6 and 8) of the first and second elongate members (4 and 5);

first and second support arms (13 and 14) respectively slidable within the first and second sleeves (11 and 12) and each having first and second ends (15 and 16, and 17 and 18);

first and second stops (19 and 20) respectively provided at the first ends (16 and 17) of the first and second support arms (13 and 14);

first and second cross-braces (21 and 22) respectively provided with first ends (23 and 24) pivotally connected to the second ends (16 and 18) of the first and second support arms (13 and 14), respectively, and respectively provided with second ends (25 and 26) pivotally connected at or adjacent the second ends (9 and 7) of the second and first elongate members (5 and 4), respectively; and support means (27, 28, 36 to 39, 44 to 47, 52 and 53) for limiting the separation of the second ends (16 and 18) of the first and second support arms (13 and 14); characterised in that:

the support means comprise:

third and fourth elongate members (27 and 28) which each have first and second ends (29 and 30, and 31 and 32) and are pivotally interconnected to form a second X-frame (33);

third and fourth sleeves (36 and 37) respectively connected, for pivotal movement, to the first ends (29 and 31) of the third and fourth elongate members (27 and 28);

third and fourth support arms (38 and 39) respectively slideable within the third and fourth sleeves (36 and 37) and each having first and second ends (40 and 41, and 42 and 43);

third and fourth stops (44 and 45) respectively provided at the first ends (40 and 42) of the third and fourth support arms (38 and 39); and third and fourth cross-braces (46 and 47) respectively provided with first ends (48 and 49) pivotally connected to the second ends (41 and 43) of the third and fourth support arms (38 and 39), respectively, and respectively provided with second ends (50 and 51) pivotally connected at or adjacent the second ends (32 and 30) of the fourth and third elongate members (28 and 27), respectively;

the second ends (16 and 41) of the first and third support arms (13 and 38) are interconnected and are each pivotable about an axis which extends perpendicular to a plane defined by the axes of the first and third support arms (13 and 38) and the axes of the first and third cross-braces (21 and 46); and the second ends (18 and 43) of the second and fourth support arms (14 and 39) are interconnected and are each pivotable about an axis which extends perpendicular to a plane defined by the axes of the second and fourth support arms (18 and 39) and the axes of the second and fourth cross-braces (22 and 47).

6. A collapsible structure (2 or 3), according to claim 5, characterised in that the support means comprise:

a first interconnecting bracket (52) providing pivotal connections for the second ends (16 and 41) of the first and third support arms (13 and 38) which second ends (16 and 41) are respectively pivotable about two spaced axes extending perpendicular to a plane defined by the axes of the first and third support arms (13 and 38) and of the first and third cross-braces (21 and 46); and a second interconnecting bracket (53) providing pivotal connections for the second ends (18 and 43) of the second and fourth support arms (14 and 39) which second ends (18 and 43) are respectively pivotable about two spaced axes extending perpendicular to a plane defined by the axes of the second and fourth support arms (14 and 39) and of the second and fourth cross-braces (22 and 47).

7. A collapsible structure, according to claim 1, 2, 3 5 or 6, characterised in that locking means, for holding the structure in an extended condition, include stiffening strips (54) positioned between the first and second ends (15 and 16, 17 and 18, 40 and 41, or 43 and 43) of each support arm (13, 14, 38, or 39) so as to support the sleeve (11, 12, 36 or 37) which slideably receives said support arm (13, 14, 38 or 39) in abutment with the stop (19, 20, 44, or 45) provided that the first end (15, 17, 40, or 45) of said support arm (13, 14, 38, or 39).

8. A collapsible structure ( 1, 2 or 3), according to claim 7, characterised in that:

a collapsible container (55) has a rim (56) which is supported by said support arms (13, 14, 38 and 39); and the stiffening strips (54) are attached to said rim (56).

9. A collapsible structure (1, 2 or 3), according to claim 8, characterised in that:

the collapsible container (55) is a rectangular parallelepiped having rectilinear edges; and stiffening members (57, 58 and 59) are provided for reinforcing at least some of said edges so as to impart rigidity to the structure (1, 2 or 3).

10. A collapsible structure (1, 2, or 3), according to claim 9, characterized in that at least some of said edges are detachably connected to said cross-braces (21, 22, 46 and 47).

* * * * *